US005293181A

United States Patent [19]

Iwao et al.

[11] Patent Number: 5,293,181

[45] Date of Patent: Mar. 8, 1994

[54] IMAGE RECORDING APPARATUS

[75] Inventors: Naoto Iwao, Nagoya; Shoji Yamada, Aichi, both of Japan

[73] Assignee: Brother Kogyo Kabushiki Kaisha, Nagoya, Japan

[21] Appl. No.: 783,248

[22] Filed: Oct. 28, 1991

[30] Foreign Application Priority Data

Oct. 29, 1990 [JP] Japan ..... 2-291116

[51] Int. Cl.[5] ..... B41J 2/415

[52] U.S. Cl. ..... 346/140 R; 310/326; 346/159

[58] Field of Search ..... 346/140 R, 159; 355/261, 162; 310/326; B41J 2/005, 3/385, 2/415

[56] References Cited

U.S. PATENT DOCUMENTS 3,689,935 9/1972 Pressman et al. ..... 346/159
4,491,855 1/1985 Fujii et al. ..... 346/159
4,498,090 2/1985 Honda et al. ..... 346/159
4,746,929 5/1988 Lin et al. ..... 310/326 X
5,153,611 10/1992 Kokado et al. ..... 346/140 R

FOREIGN PATENT DOCUMENTS 0410738 1/1991 European Pat. Off. ..... 355/261
0287568 11/1990 Japan .

*Primary Examiner*—Benjamin R. Fuller
*Assistant Examiner*—Alrick Bobb
*Attorney, Agent, or Firm*—Oliff & Berridge

[57] ABSTRACT

An image recording apparatus comprises an aperture electrode for modulating and regulating a flow of charged toner particles, and a vibrating device for vibrating the aperture electrode. The vibration generated by the vibrating device is a progressive wave transmitted in the aperture electrode. Since all of the apertures of the aperture electrode efficiently vibrate at a sufficient amplitude, adhesion of the toner particles to the aperture electrode is easily prevented.

13 Claims, 10 Drawing Sheets

IMAGE RECORDING APPARATUS

BACKGROUND OF THE INVENTION

This invention relates to an image recording apparatus which directly regulates and modulates a flow of toner particles for recording images.

Currently, an image recording apparatus which records images by jetting toner particles has been proposed, for example, in U.S. Pat. No. 3,689,935. According to the disclosure of this patent, the image recording apparatus comprises a toner supply, an aperture electrode having a plurality of apertures, and a back electrode. The toner supply provides charged toner particles, and projects the toner particles toward the aperture electrode. The aperture electrode, which regulates and modulates the flow of the toner particles, comprises an insulative layer provided with multiple apertures or holes, a first electrode layer coated on one side of the insulative layer, and a second insulative layer coated on the side of the insulative layer opposite to the first electrode layer. The second electrode layer includes multiple isolated segments which respectively surround each of the apertures. The back electrode facing the aperture electrode attracts and supports a support medium such as paper. The apparatus for recording images thus constructed controls the flow of the toner particles by applying electric signals individually to the aperture electrode and the back electrode, thereby recording images on the support medium.

However, upon recording images with the above-mentioned apparatus, the toner particles adhere to and block the apertures of the aperture electrode. More particularly, the inner diameter of the apertures must be approximately 50 μm or less in order to obtain an image density of 240 DPI (dot per inch), since the maximum dot diameter is 100 μm. As a result of residual charge from image signals and the like, the toner particles adhere to the aperture electrode due to the image force and the like. The toner particles thus block the small apertures, making the output images irregular.

SUMMARY OF THE INVENTION

An object of the present invention is to solve the aforementioned problem by providing an image recording apparatus in which toner particles are uniformly and effectively prevented from adhering to an aperture electrode in order to obtain stable and uniform output images.

To attain the object, the image recording apparatus of the present invention comprises an aperture electrode for modulating and regulating a flow of charged toner particles, and a vibrating device for vibrating the aperture electrode. The vibration generated by the vibrating device is a progressive wave transmitted in the aperture electrode. The progressive wave preferably advances in the direction of the row of apertures.

According to the image recording apparatus thus constructed, all of the apertures of the aperture electrode efficiently vibrate having a sufficient amplitude. Therefore, the adhesion of the toner particles to the aperture electrode is easily prevented.

DETAILED DESCRIPTION OF PREFERRED EMBODIMENTS

Preferred embodiments will appear in the course of the following description with reference to the drawings.

EMBODIMENT 1

Figure 4:
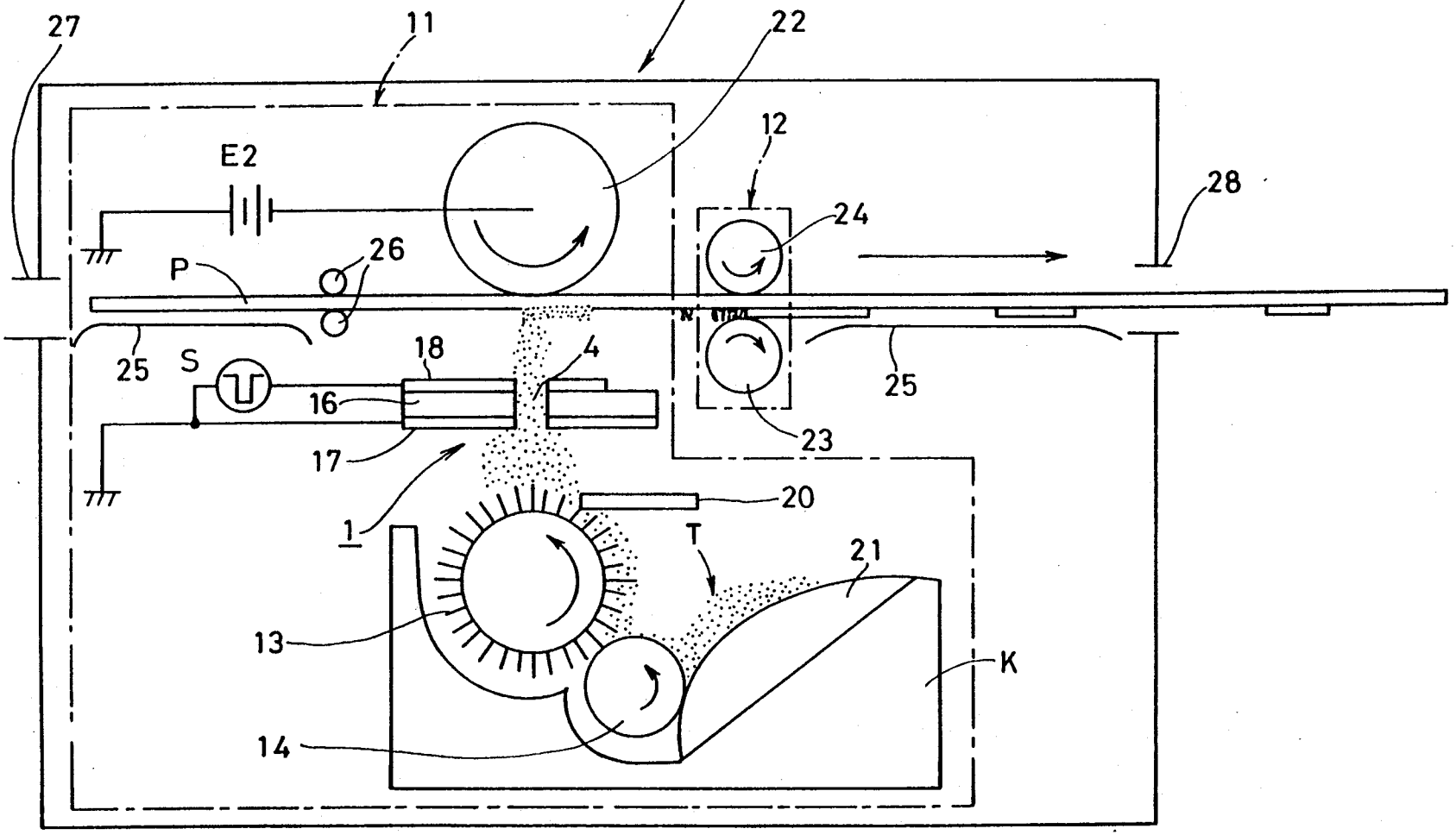
FIG. 4 is a schematic view showing an image recording apparatus comprising the aperture electrode.

As shown in FIG. 4, an image recording apparatus 10 comprises an image recording portion 11 and a thermal fixing portion 12. An entrance 27 is formed on one side of the image recording apparatus 10, and an exit 28 on the other side thereof. A support medium P, such as paper, enters through the entrance 27. The image recording portion 11 forms images on the support medium P. The thermal fixing portion 12 fixes the images on the support medium P by heating. Then the support medium P is guided by a guide member 25 and is discharged from the exit 28.

The image recording portion 11 includes a rotatable brush roller 13, an aperture electrode 1, and a back electrode 22. The brush roller 13 contacts a supply roller 14. The supply roller 14 further contacts a supply blade 21. The supply blade 21 supplies toner T stored thereon to the supply roller 14. The supply roller 14 rotates in the same direction as the brush roller 13 rotates to provide the toner T to the brush roller 13. A deflection member 20 causes particles of toner T to issue from the brush roller 13 and form a suspension or cloud of charged particles. The supply roller 14 and the supply blade 21 are accommodated in a case K. The aperture electrode 1 is positioned above the brush roller 13.

The structure of the aperture electrode 1 is now described with reference to FIG. 1. The aperture electrode 1 comprises multiple apertures 4, an insulative layer 16, a base electrode layer 17, multiple segmented control electrodes 18. A vibrating device 2 is fixed onto the aperture electrode 1 for providing progressive waves in the aperture electrode 1. The aperture electrode 1 is sized and constructed to perform a bending vibration at a predetermined frequency fr of about 45 kHz in a manner shown in FIG. 2.

The vibrating device 2 includes a vibrator 5 mounted at one end of the aperture electrode 1 for vibrating the aperture electrode 1, and a reflected wave absorber 6 mounted at the opposite end of the aperture electrode 1 in the direction of an arrow X. The vibrator 5 includes a langevin vibrator having a resonance frequency of fr kHz. The vibrator 5 is connected with an actuator 7 which generates electric signals having a frequency of fr kHz. The reflected wave absorber 6 is also made of a langevin vibrator. The reflected wave absorber 6 is connected with an impedance member 8 which consumes the vibrational energy of the vibration absorbed by the reflected wave absorber 6 to prevent the generation of the reflected wave. More specifically, the impedance value (resistance value and/or reactance value) of the impedance member 8 is matched with the impedance value of the aperture electrode 1 adjacent to the reflected wave absorber 6. The aperture electrode 1 thus appears to endlessly vibrate as seen from the vibrator 5 side. Consequently, only progressive waves generate in the aperture electrode, thereby preventing the generation of standing waves.

The apertures 4 are formed on the insulative layer 16 at the center in the direction of an arrow z. The apertures 4 are arranged in a row forming a row of apertures 3. The base electrode layer 17 is mounted beneath the insulative layer 16 and above the brush roller 13. The segmented control electrodes 18 individually surround each of the apertures 4 on the insulative layer 16. The base electrode layer 17 is grounded. The segmented control electrodes 18 are connected with a signal source S as shown in FIG. 4.

In FIG. 4, the back electrode 22 is positioned above the aperture electrode 1. The support medium P inserted through the entrance 27 and guided by the guide 25 and a pair of assisting rollers 26 goes between the back electrode 22 and the aperture electrode 1. The back electrode 22 is connected to the negative electrode of a power source E2. The Toner T coming through the apertures 4 adheres to the support medium P by applying voltage from the power source E2.

The thermal fixing portion 12 comprises a heat roller 23 provided with a heat source, and a press roller 24. The support medium P goes between the heat roller 23 and the press roller 24 after passing the image recording portion 11.

The operation of the image recording apparatus of the invention will be described with reference to the FIG. 4. The support medium P enters the image recording apparatus 10 through the entrance 27, and reaches the image recording portion 11. The supply blade 21 presses the toner T on the supply roller 14, and the supply roller 14 carries the toner T. The supply roller 14 supplies the toner T to the brush roller 13. The toner particles T are charged positively by contacting the supply roller 14 and the brush roller 13 by triboelectric effects. The positively charged toner T is carried by the brush roller 13.

Under the aperture electrode 1, the deflection member 20 bends the brush of the brush roller 13. A desired amount of the toner T springs up as the bent brush of the brush roller 13 returns elastically to its original shape and position. Consequently, the clouds of the toner T are supplied to the aperture electrode 1. Then the flow of the toner T is regulated and modulated by applying voltage to the segmented control electrodes 18 of the aperture electrode 1.

Then the actuator 7 applies an electric signal of frequency fr kHz to the vibrator 5. Progressive waves, which is diagrammically shown in FIG. 3B, are generated in the aperture electrode 1. Thus, the image force and the like cannot attract the toner T to the apertures 4, since a large vibrating acceleration of the progressive wave is generated at the apertures 4. Consequently, the flow of the toner T is stably modulated by the signal source S, and is recorded on the support medium P.

The back electrode 22 connected to the negative electrode of the power source E2 attracts the positively charged toner T. The toner T adheres to the support medium P guided by the guide 25 and the assisting rollers 26.

Then the support medium P reaches the thermal fixing portion 12, where the images are fixed on the support medium P by the heat roller 23 and the press roller 24. This fixation of the images is performed by a known method. Finally, the support medium P carrying the images is guided by another guide 25, and is discharged through the exit 28.

Figure 1:
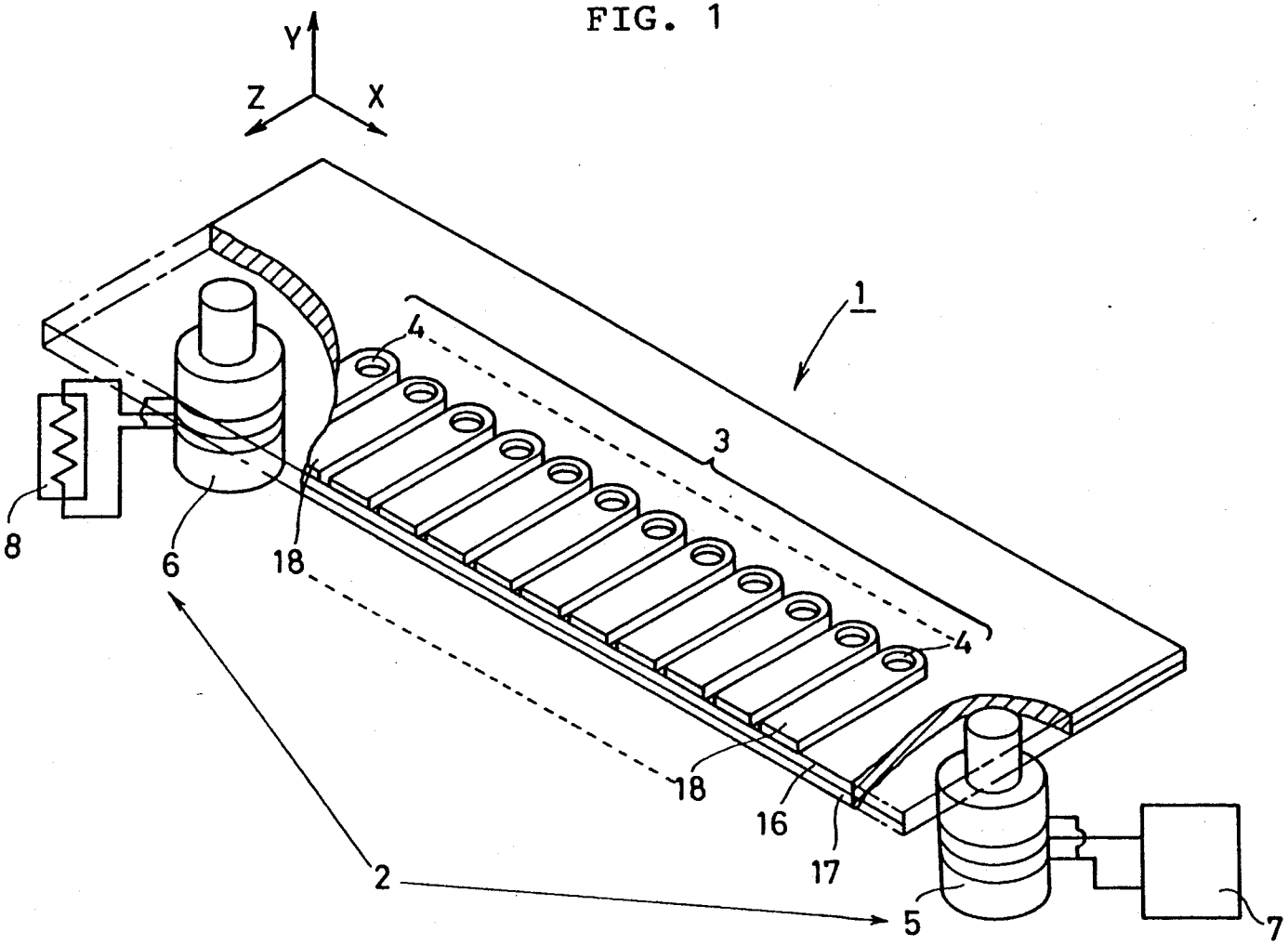
FIG. 1 is a perspective view showing a first embodiment of an aperture electrode.
Figure 2:
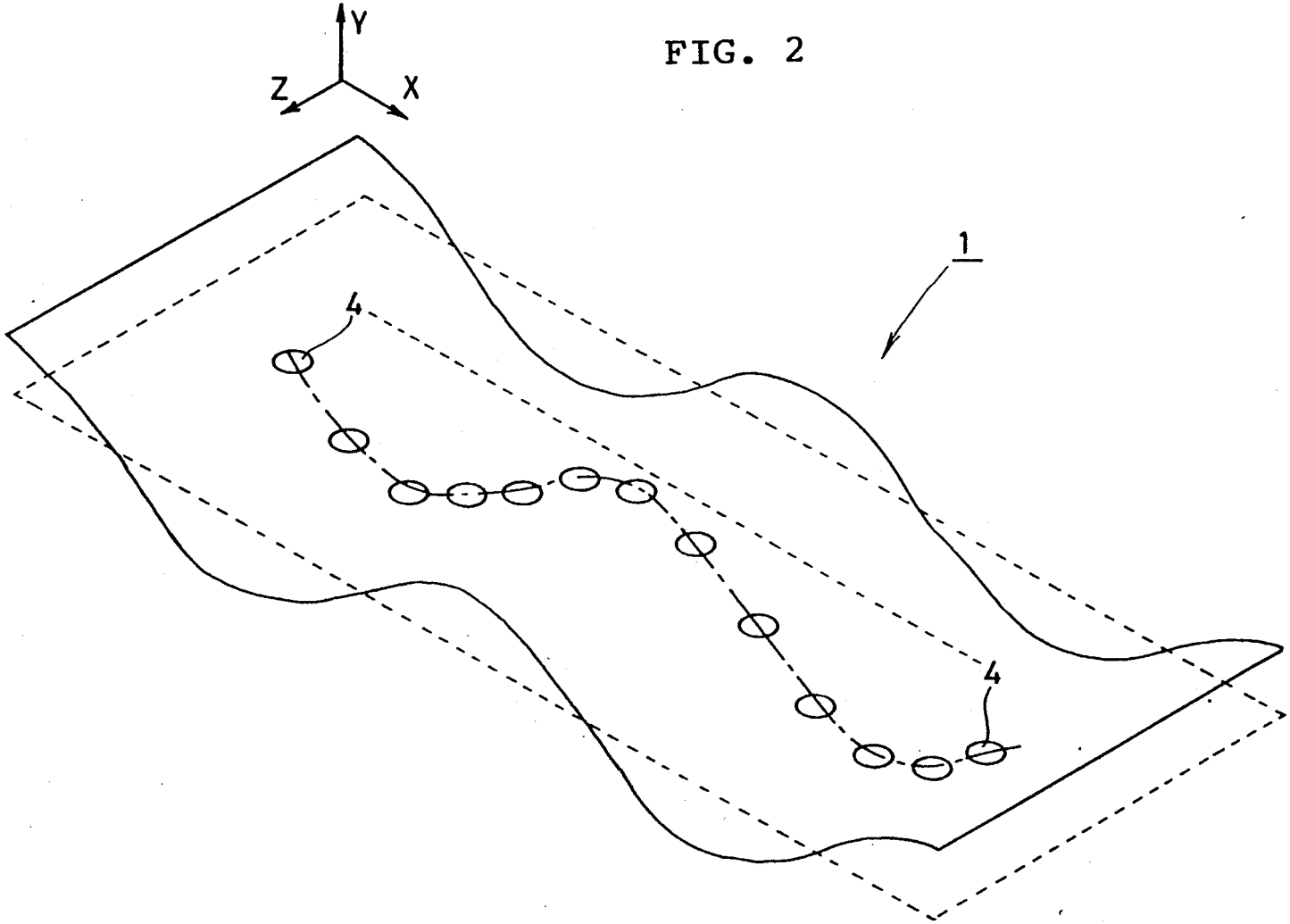
FIG. 2 is an explanatory view of the aperture electrode undergoing a bending vibration.
Figure 3A:
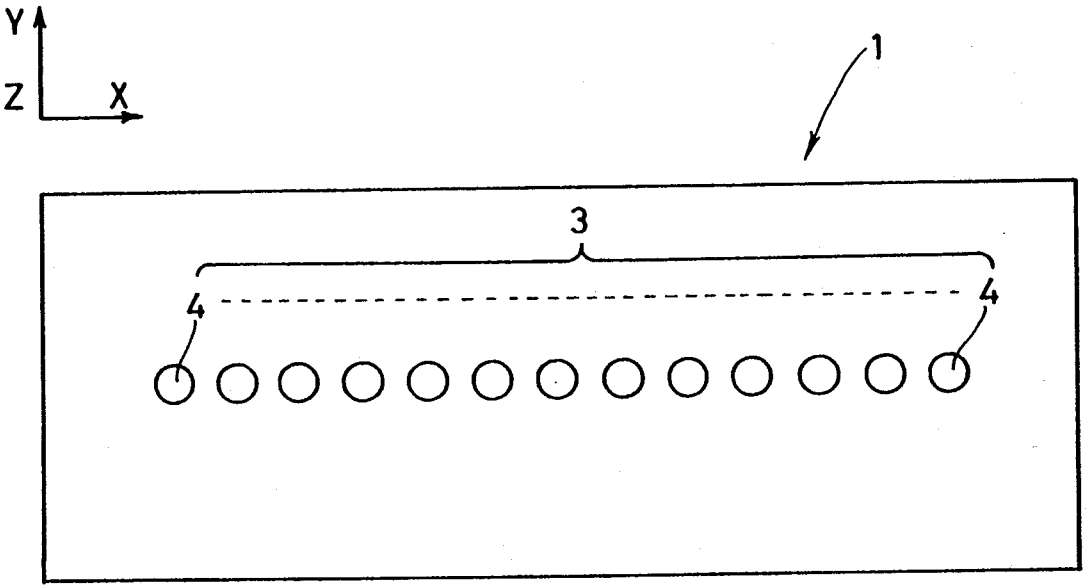
FIGS. 3A and 3B are diagrammatic views comparatively showing the aperture electrode and progressive waves generated therein, respectively.
Figure 3B:
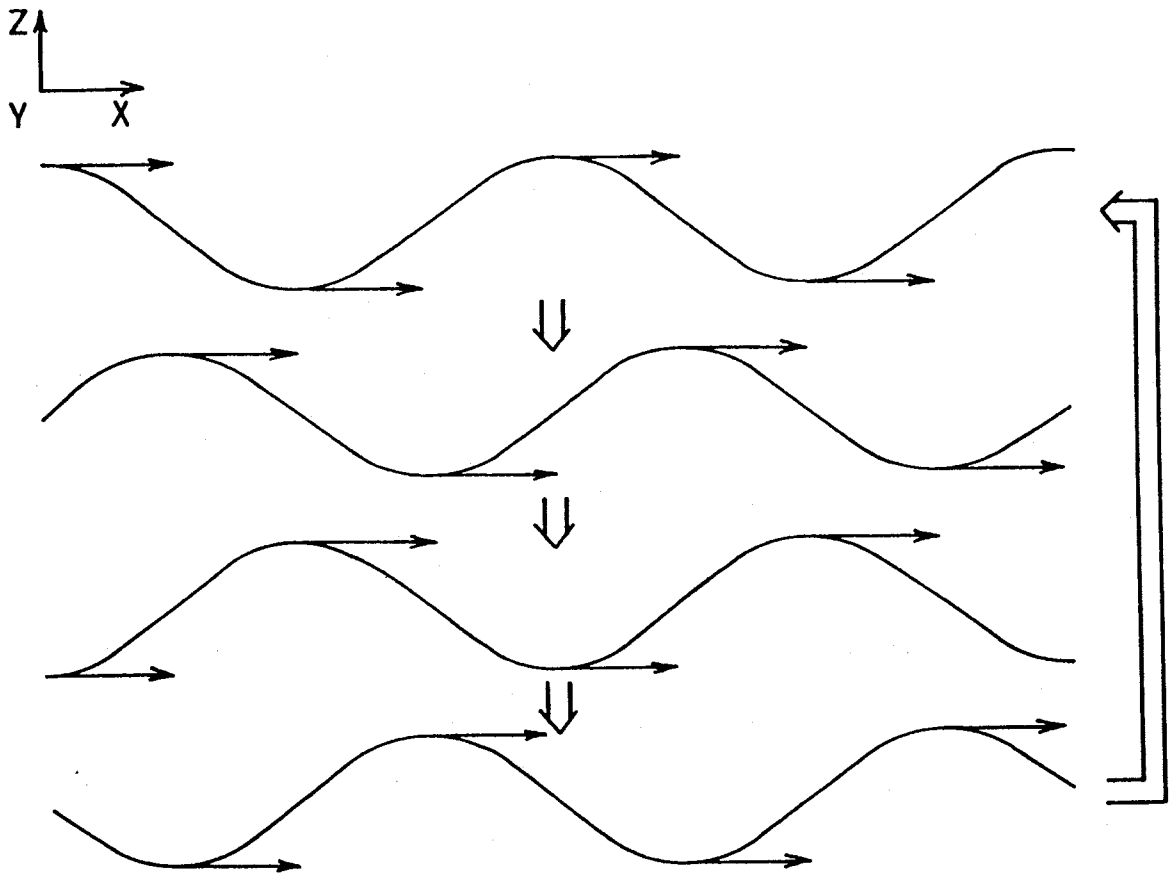

As shown in FIGS. 1 through 3, the toner T is prevented from adhering onto the aperture electrode 1 by the following steps. When the actuator 7 applies an electric signal of a predetermined frequency fr kHz to the vibrator 5 during recording images, the aperture electrode 1 undergoes bending vibrations in a manner shown in FIG. 2. The vibration is transmitted in the direction of the arrow x. When the vibration reaches to the opposite end of the aperture electrode 1, the reflected wave absorber 6 absorbs the vibrational energy. The impedance member 8 dissipates the absorbed vibrational energy. Thus, a reflected wave is not generated. Instead, a progressive wave shown in FIG. 3B generates in the direction of the arrow x, i.e. along the row of the apertures 3. Therefore, since the aperture electrode 1 vibrates having a sufficient vibrational amplitude at the apertures 4, all of the apertures 4 obtain the maximum vibrating acceleration. Thus, the toner T cannot attach to the aperture electrode 1 around the apertures 4. Typically, the higher the vibrating acceleration is, the more difficult it is for the toner T to adhere onto the aperture electrode 1. The adhesion of the toner T to the apertures 4 is thus more effectively prevented by increasing the vibrational amplitude and the frequency. Since the amplitude generally decreases when the frequency is raised, the frequency needs to be determined according to the material of the aperture electrode 1 or other conditions.

EMBODIMENT 2

An image recording apparatus of the second embodiment is characterized in that an aperture electrode is an endless belt in the direction in which the progressive waves advance in the aperture electrode. Therefore, a reflected wave absorber for absorging reflected waves is not necessary for the image recording apparatus of this embodiment. The aperture electrode can thus be vibrated without dissipating vibrating energy. It is desirable that the progressive waves advance in the direction of the row of the apertures of the aperture electrode.

Figure 5:
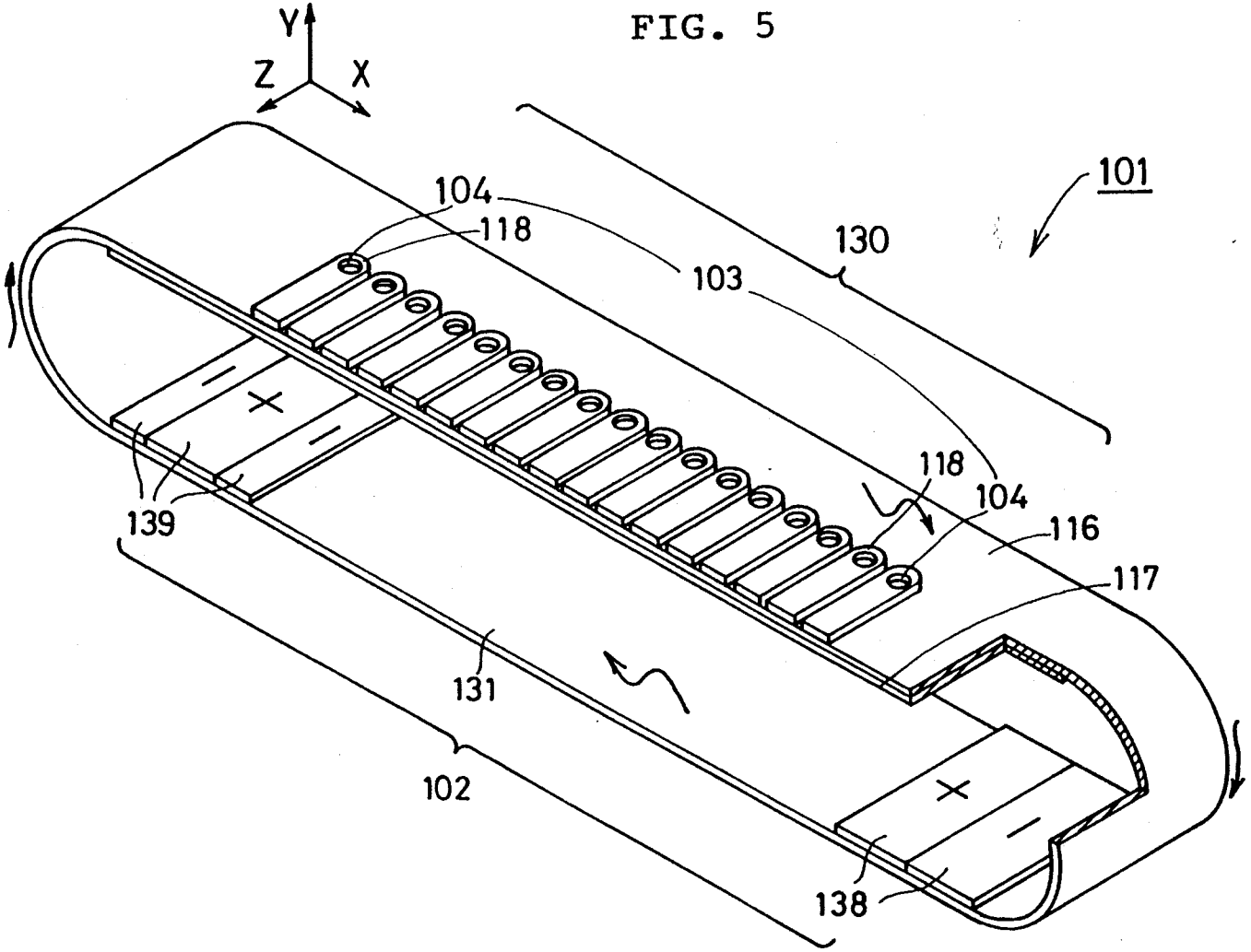
FIG. 5 is a perspective view showing a second embodiment of an aperture electrode.
Figure 6:
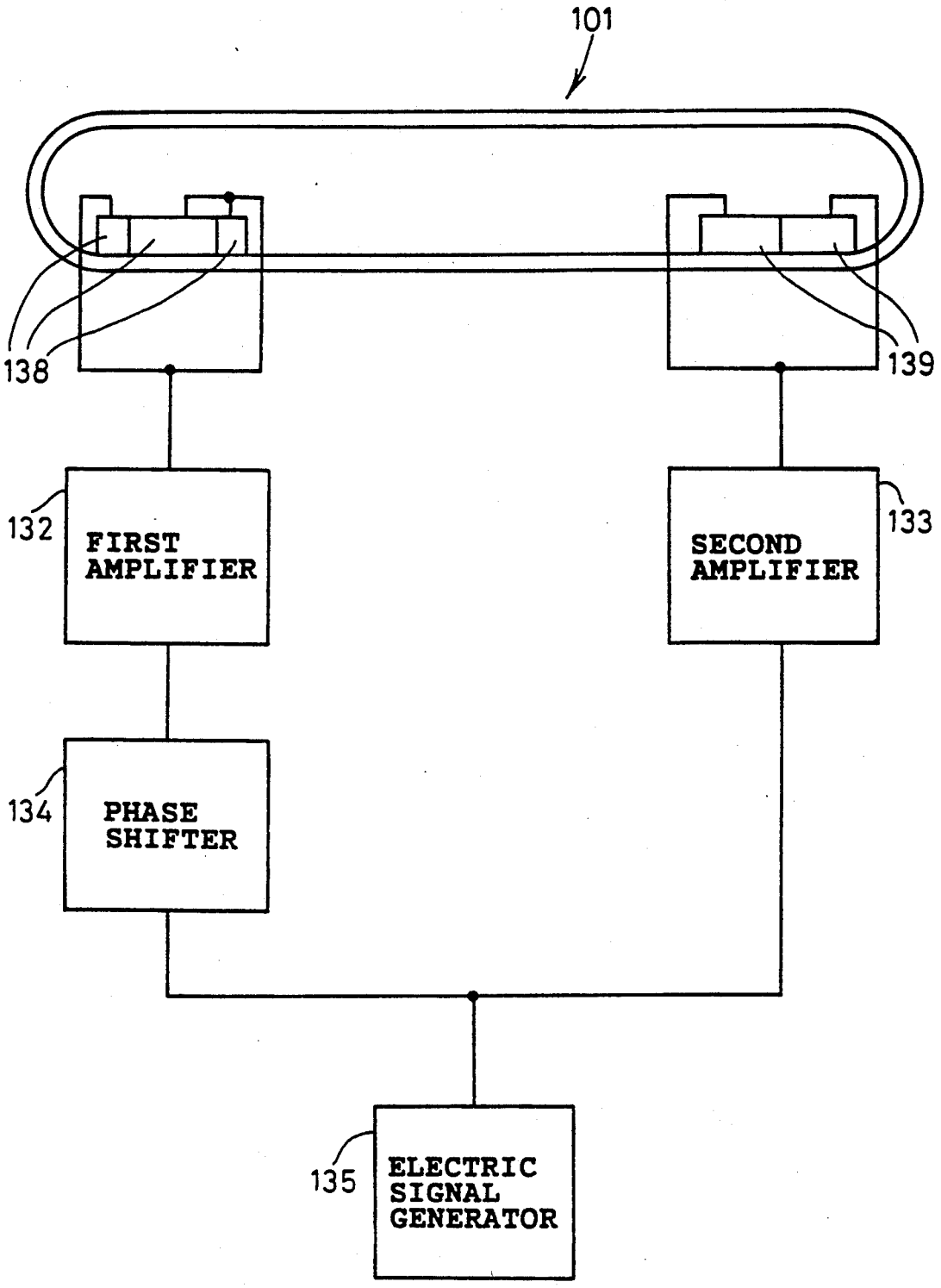
FIG. 6 is a block diagram showing an electrical system for generating bending progressive waves in the second embodiment of the aperture electrode.

The constitution of an aperture electrode 101 is described with reference to FIGS. 5 and 6. The aperture electrode 101 comprises a modulating portion 130 and a toner cloud portion 131. The modulating portion 130 is the upper plane surface of the aperture electrode 101. The toner cloud portion 131 is the lower plane surface of the aperture electrode 101. The modulating portion 130 includes an endless belt-shaped insulative layer 116, multiple apertures 104, multiple segmented control electrodes 118, and a base electrode layer 117. The aperture electrode 101 further comprises a vibrating device 102, which is fixed to the aperture electrode 101 for applying progressive waves to the aperture electrode 101. The vibrating device 102 includes a first piezoelectric element 138 and a second piezoelectric element 139. The first and second piezoelectric elements 138 and 139 are positioned such that the positional phase difference of the bending vibrations generated by the piezoelectric elements 138 and 139 is one fourth of the wave length of the applied vibration. As shown in FIG. 6, the first piezoelectric element 138 is connected to a first amplifier 132, and the second piezoelectric element 139 is connected to a second amplifier 133, respectively. Further, the first amplifier 132 is connected with a phase shifter 134 which shifts the phase of the vibration by ninety degrees. The phase shifter 134 and the second amplifier 133 are connected with an electric signal generator 135.

The apertures 104 are formed in the modulating portion 130 at the center in a direction of an arrow z, forming a row of apertures 103. The segmented control electrodes 118 individually surround the apertures 104 on the insulative layer 116. The base electrode layer 117 is formed on the insulative layer 116 on the surface opposite to the segmented control electrodes 118. The base electrode layer 117 is grounded. The segmented control electrodes 118 are connected to the signal source S.

After being positively charged and carried on the brush roller 13 in the manner shown in the first embodiment, the toner T is supplied onto the toner cloud portion 131. When the electric signal generator 135 generates an electric signal of a frequency f to the second piezoelectric element 139, the aperture electrode 101 effects a bending vibration shown by the equation $Y=A\cdot\sin\omega t\cdot kx$ in which k, t, and A indicate the number of waves of the bending vibration, time, the amplitude of the bending vibration, respectively. If the electric signal generator 135 generates an electric signal of the frequency f to the first piezoelectric element 138, the aperture electrode 101 attains a bending vibration shown by the equation $Y=A\cdot\cos\omega t\cdot\cos kx$. The time and position phase difference between each vibration generated by the first and second piezoelectric element 138 and 139 is ninety degrees. Consequently, by combining the two bending vibrations, the aperture electrode 101 generates progressive waves shown by the equation $Y=A\cdot\cos(\omega t-kx)$. The progressive wave thus generated provides the toner T with the vibrating acceleration in the direction of an arrow Y. The cloud or mist of the toner T is supplied to the modulating portion 130. The signal source S applies voltage to the segmented control electrodes 118 for modulating the flow of the toner T. The great vibrating acceleration generated by the progressive wave prevents the toner T from adhering to the row of apertures 103. Therefore, the flow of the toner T is stably modulated by the signal source S, effecting the stable image recording on the support medium P.

According to the image recording apparatus of this embodiment, the aperture electrode 101 is an endless belt. Thus, reflected waves need not be absorbed. Further, the toner cloud portion 131 for providing toner clouds also prevents the adhesion of the toner to the aperture electrode 101. Therefore, the image apparatus of the embodiment can use the supplied energy effectively.

EMBODIMENT 3

The image recording apparatus of the third embodiment is characterized in that the oscillation frequency of the progressive wave generated in an aperture electrode is kept lower than the frequency of the membrane vibration of the aperture electrode. Thus, the membrane vibration is not generated in the aperture electrode, thereby preventing the noise generated by the membrane vibration.

Figure 7:
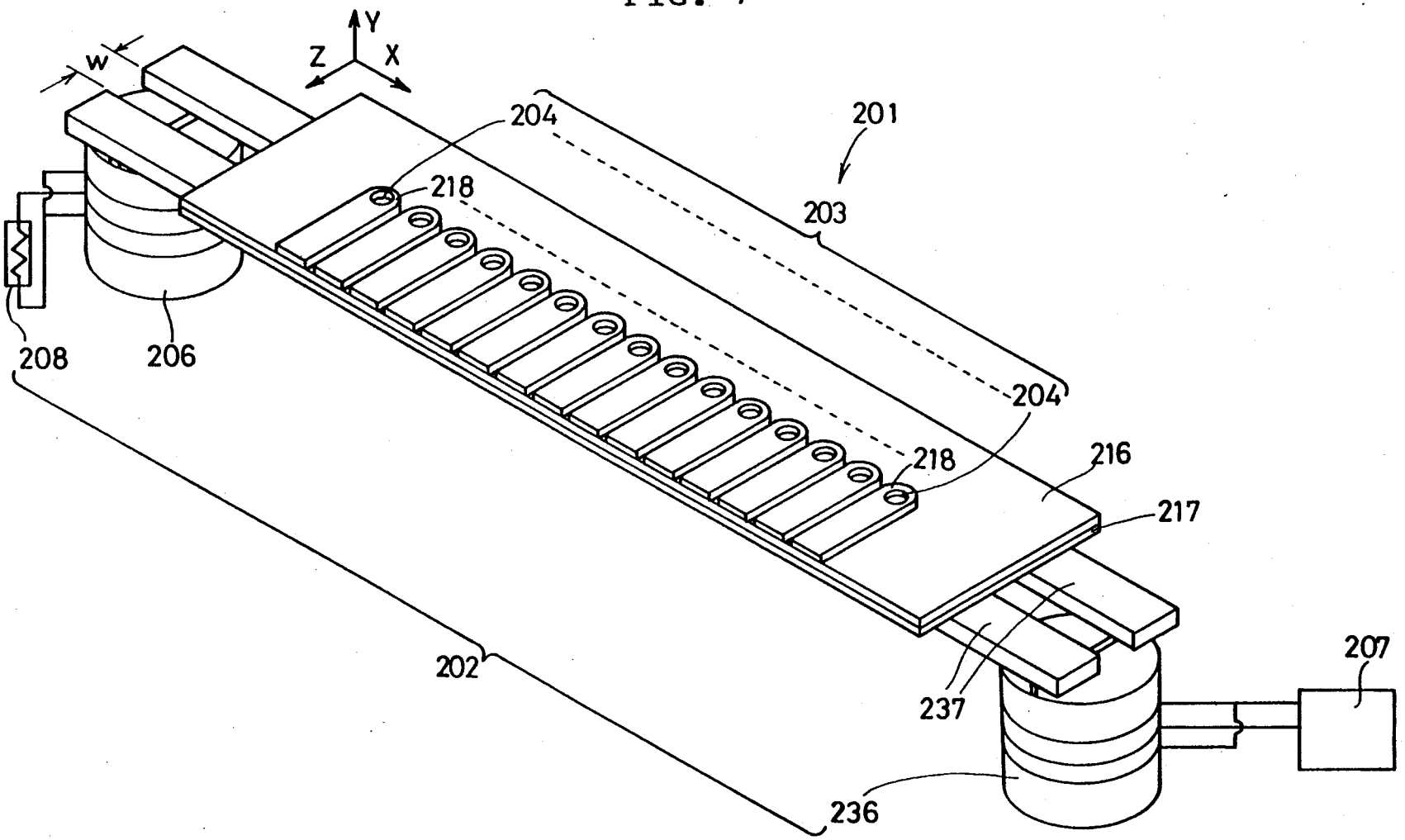
FIG. 7 is a perspective view of a third embodiment of an aperture electrode.

As shown in FIG. 7, an aperture electrode 201 comprises multiple apertures 204, an insulative layer 216, a base electrode layer 217, and multiple segmented control electrodes 218. A vibrating device 202 fixed onto the aperture electrode 201 comprises a metal vibrator 237 beneath the base electrode layer 217, a vibrating member 236 fixed onto one end of the vibrator 237, and a reflected wave absorber 206 attached onto the other end of the vibrator 237 in the direction of an arrow z. The vibrator 237 is fixed onto the electrode 201 by means of an adhesive, a screw, or other attachment methods. The vibrating member 236 provides the vibrator 237 with progressive waves, which generate the vibrating acceleration in the aperture electrode 201. The vibrator 237 includes a pair of elongated elastic bodies positioned parallel to the row of apertures 203 having a predetermined interval w between the two elongated bodies. The vibrating member 236 is made of a langevin vibrator having a resonance frequency of fr, and is connected to an actuator 207 which generates an electric signal having a frequency fr. The reflected wave absorber 206 also includes a langevin vibrator, which is connected with an impedance member 208. The impedance member 208 dissipates the vibrating energy of the reflected waves absorbed by the reflected wave absorber 206, in order to prevent the generation of the reflected waves in the aperture electrode 201.

The interval w between the two elongated elastic bodies of the vibrator 237 is determined as follows. If Young's modulus, the density, and the Poisson ratio of the material of the aperture electrode 201 are E, $\rho$, and $\gamma$, respectively, and the thickness of the aperture electrode 201 is t, the relationship between the interval w and the resonance frequency f of the bending vibration at the lowest mode of the aperture electrode 201 is shown by the equation:

$$f=\frac{1.506^2\pi t}{2w^2}\sqrt{\frac{E}{12(1-\nu^2)\rho}}$$

Thus, if the resonance frequency f is set higher than the frequency fr of the progressive wave of the vibrator 237 generated by the vibrator 236 and the reflected wave absorber 206, i.e. f>fr, the interval w is shown by the equation:

$$w<\sqrt{\frac{1.506^2\pi t}{2fr}\sqrt{\frac{E}{12(1-\nu^2)\rho}}}$$

When the interval w is determined as aforementioned, a membrane vibration, such as the type which is generated in a vibrating plate of a speaker, is not generated in the aperture electrode 201 even when the progressive wave is generated by the vibrator 237. Thus, the noise due to the membrane vibration is prevented in advance.

When the flow of the toner T is modulated at the aperture electrode 201 in the same manner as in the first embodiment, the actuator 207 applies an electric signal having a frequency fr to the vibrating member 236.

Then the progressive wave shown in FIG. 3B is generated in the vibrator 237. Since the apertures 204 obtain the great vibrating acceleration of the progressive wave, the toner particles cannot adhere to the apertures 204. Further, since the interval w of the vibrator 237 is determined by the equation:

$$w < \sqrt{\frac{1.506^2 \pi t}{2fr}} \sqrt{\frac{E}{12(1-\nu^2)\rho}}$$

such that the resonance frequency f of the basic membrane vibration of the aperture electrode 201 is higher than the frequency fr of the progressive wave, the generation of membrane vibration of the aperture electrode 201 and consequent noise are prevented. Therefore, the flow of the toner particles is stably and noiselessly modulated by the source signal S to be recorded on the support medium P.

When the actuator 207 applies an electric signal having the predetermined frequency fr to the vibrating member 236, the vibrator 237 effects the bending vibrations shown in FIG. 3B. The vibrations advance in the direction of the arrow x. When the vibration reaches the opposite end of the vibrator 237, the reflected wave absorber 206 absorbs the vibrational energy of the vibration, which is dissipated by the impedance member 208. Thus, the generation of reflected waves is prevented and only progressive waves which advance in the direction of the arrow x, i.e. the row of apertures 203 are generated. Since the apertures 204 obtain the greatest vibrating acceleration from the progressive wave, the toner particles are prevented from adhering to the apertures 204. Moreover, the noise due to the membrane vibration of the aperture electrode 201 is easily prevented in advance.

EMBODIMENT 4

The image recording apparatus of the fourth embodiment is characterized in that a vibrating device includes of a polymeric piezoelectric element, which is directly connected to an aperture electrode. Since the vibrating device is thus constructed, the mechanical impedance value of the vibrating device can be easily matched with the impedance value of the aperture electrode. Further, since the vibration applied to the aperture electrode is directly controlled, toner particles are effectively prevented from adhering to the aperture electrode.

Figure 8:
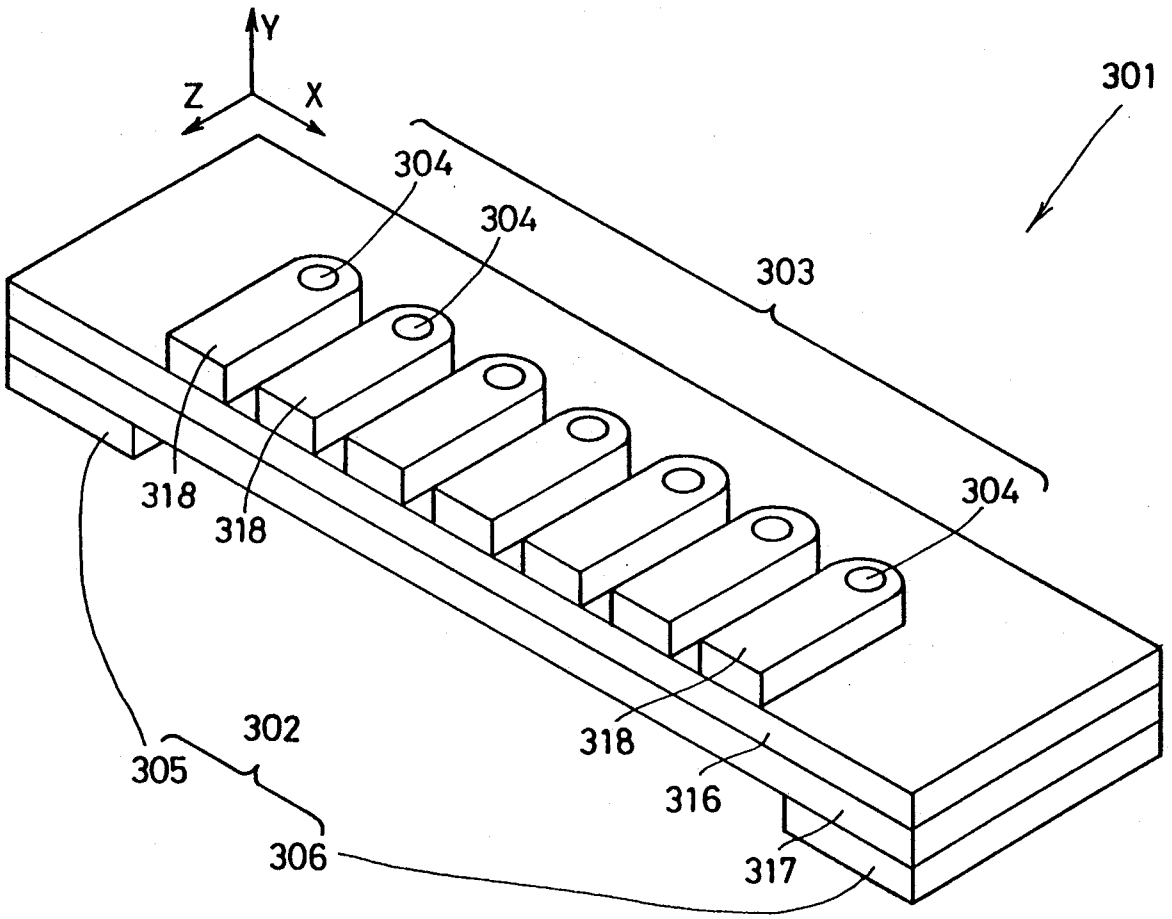
FIG. 8 is a perspective view of a fourth embodiment of an aperture electrode.
Figure 9:
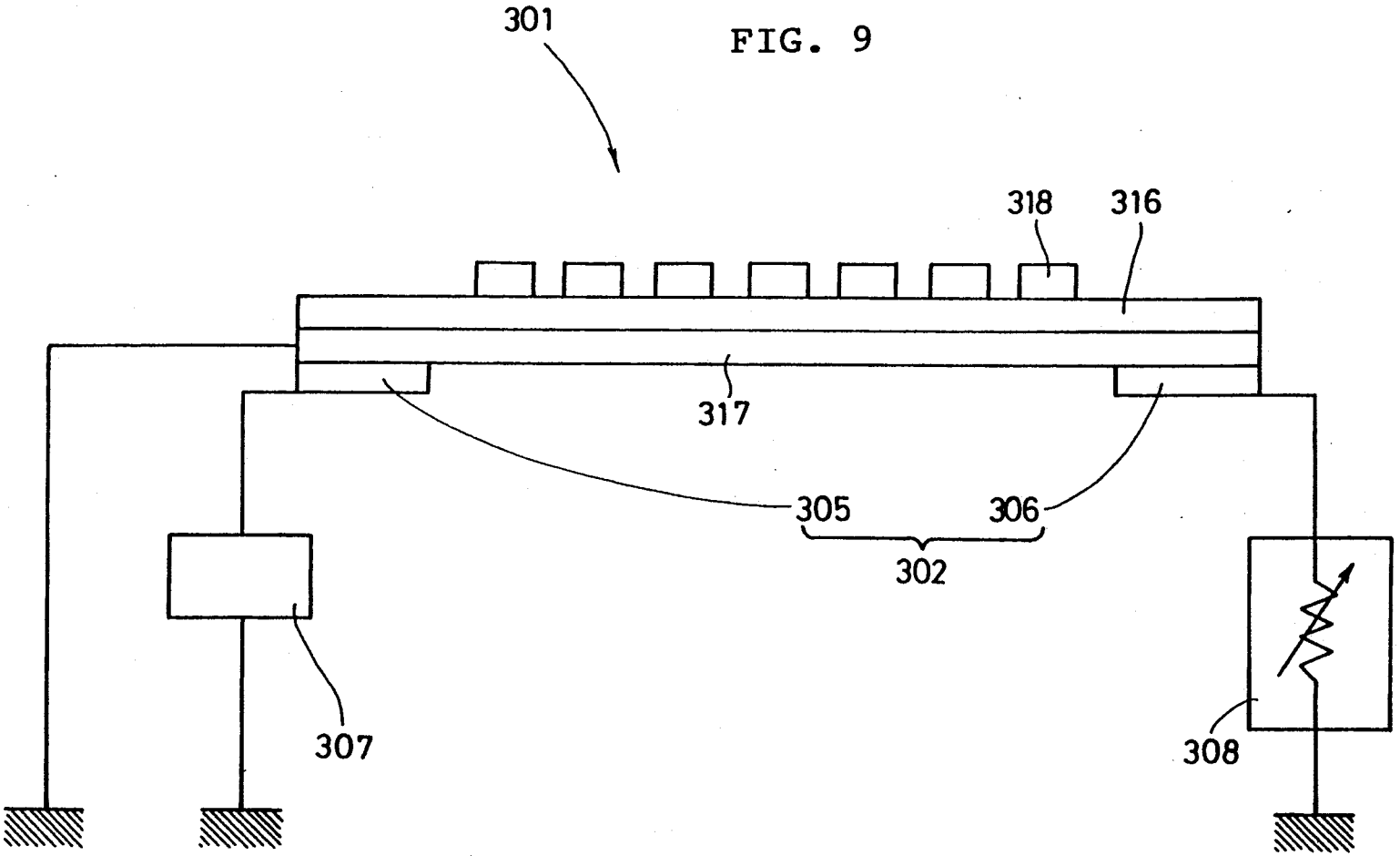
FIG. 9 is an explanatory view showing the electric connections of a vibrating device for the fourth embodiment.

As shown in FIG. 8, an aperture electrode 301 comprises multiple apertures 304, an insulative layer 316, a base electrode layer 317, multiple segmented control electrodes 318. A vibrating device 302 for generating progressive waves in the aperture electrode 301 is attached onto the base electrode layer 317. The insulative layer 316 typically includes a polymeric material such as polyimide.

The vibrating device 302 includes a vibrator 305 and a reflected wave absorber 306. The vibrator 305 is fixed onto one end of the aperture electrode 301, and the reflected wave absorber 306 is attached onto the opposite end thereof in the direction of an arrow x. Both of the vibrator 305 and the reflected wave absorber 306 are made of a polymeric piezoelectric material such as polyvinylidene fluoride (herein after referred to as "PVDF"). PVDF is a polarized polymer which is polarized in a strong electric field and provided with stable polarization in its membrane. Further, the PVDF comprises atoms whose chain of molecular structure possesses dipole moment. Therefore, the PVDF obtains great piezoelectricity and pyroelectricity in an electric field, and possesses various advantages unique to polymeric materials such as shock resistance, flexibility, small acoustic impedance. Moreover, in the PVDF, the performance change or other changes appearing after a period of time by applying actuating voltage are smaller, which characteristic is not seen in inorganic piezoelectric materials such as piezoelectric ceramics.

The vibrator 305 is connected to an actuator 307 which generates an electric signal of a predetermined frequency. The reflected wave absorber 306 is connected to an impedance member 308. The impedance member 308 prevents the generation of reflected waves in the aperture electrode 301 by dissipating the vibrational energy absorbed by the reflected wave absorber 306.

When the actuator 307 applies an electric signal of a predetermined frequency to the vibrator 305, the aperture electrode 301 effects a bending vibration having a displacement in the direction of an arrow z. The vibration is transmitted in the direction of an arrow x. When the vibration reaches the opposite end of the aperture electrode 301, the reflected wave absorber 306 absorbs the vibrational energy of the vibration, which is dissipated by the impedance member 308. Thus, only progressive waves are generated in the aperture electrode 301 in the direction of the arrow x, i.e. along the row of apertures 303, without the generation of reflected waves therein.

As aforementioned, the vibrating device 302 includes a polymeric material similar to or the same as that of the aperture electrode 301 with respect to their mechanical properties, and the vibrating device 302 is directly fixed onto the aperture electrode 301. Thus, the impedance match between the vibrating device 302 and the aperture electrode 301 can be easily effected, thereby enabling the vibrating device 302 to provide the aperture electrode 301 with the vibrational energy for generating progressive waves. Moreover, only desired vibrations can be generated in the aperture electrode 301 due to the direct control of the vibrations. Therefore, the adhesion of the toner particles to the aperture electrode 301 is easily prevented without any problems such as noise.

The present invention may be subject to many modifications and changes without departing from the spirit or essential characteristics thereof. For example, the vibration mode for the aperture electrodes 1, 101, 201, and 301 is not restricted to the mode shown in FIG. 2, but other modes such as a surface wave may be adopted if a progressive wave can be generated by the mode. Further, the vibrating devices 2, 102, 202, and 302 may include an electrostrictive element, magnetrostrictive element, or other element if it can convert electric energy into mechanical energy. Additionally, the progressive waves may be generated by other methods.

What is claimed is:

1. Image recording apparatus comprising:

an aperture electrode for regulating a flow of charged particles;

a vibration source connected to said aperture electrode for mechanically vibrating said aperture electrode to generate mechanical vibrational progressive waves on the aperture electrode; and means connected to said aperture electrode for preventing reflection of the mechanical vibrational progressive waves along said aperture electrode.

2. The image recording apparatus as claimed in claim 1, wherein the aperture electrode is an endless belt.

3. The image recording apparatus as claimed in claim 1, further comprising a pair of elongate members having a predetermined space therebetween, said elongate members attached to the aperture electrode, and wherein the predetermined space is selected so that a resonant vibration frequency of the aperture electrode is greater than a frequency of the progressive waves generated by the vibration source.

4. The image recording apparatus as claimed in claim 1, wherein the vibration source comprises a polymeric piezoelectric element mounted on the aperture electrode.

5. A recording apparatus comprising:

supply means for supplying toner particles;

attracting means for attracting the toner particles on a recording medium to receive the toner particles from the supply means;

generating means for generating toner particles toward the recording medium;

a control electrode disposed between the generating means and the attracting means, said control electrode comprising an electrode body, a plurality of apertures arranged in a line in the electrode body, electrodes associated with the apertures for controlling flow of toner particles through the apertures toward the recording medium;

a vibration means connected to said control electrode for mechanically vibrating a portion of the electrode in which the apertures are formed to generate mechanical vibrational waves which travel progressively in a direction along the line of the electrode body; and said vibration means having means connected to said control electrode for preventing reflection of said progressive waves in the control electrode.

6. The recording apparatus as claimed in claim 5, wherein said apertured portion of the electrode body is a substantially planar elongate member and wherein said vibration means connects to an end of the said elongate member to form said progressively traveling vibrational waves.

7. The recording apparatus as claimed in claim 6, wherein said wave reflection preventing means includes means for dissipating said progressive traveling vibrational waves.

8. The recording apparatus as claimed in claim 7, wherein said means for dissipating said progressive traveling vibrational waves comprises an absorbing means being disposed at an end of the elongate member toward which said waves travel.

9. The recording apparatus as claimed in claim 5, wherein the vibration means further comprises a pair of elongate members in engagement with the electrode body, said elongate members being spaced from each other by a predetermined distance, said predetermined distance being selected so that a resonant bending frequency of the electrode body, with said elongate members engaged therewith, is higher than a frequency of said progressive waves generated by the vibration means.

10. The recording apparatus as claimed in claim 5, wherein the vibration means comprises a polymeric piezoelectric element mounted on the electrode body.

11. The recording apparatus as claimed in claim 5, wherein the supply means comprises means for establishing a suspension of charged toner particles in the region of the control electrode.

12. A control electrode for controlling passage of toner particles to a recording medium comprising:

an electrode body;

at least one aperture in the electrode body for allowing a flow of toner particles to the recording medium;

a vibration means for mechanically vibrating the electrode body to generate mechanical vibrational waves which move progressively in a direction along the electrode body;

said vibration means having means connected to said electrode body for preventing reflection of mechanical progressive vibrational waves in said electrode body;

wherein said electrode body is elongate and has a first end and a second end, and said vibration means generates said vibrations adjacent the first end of the electrode body, so that said vibrational waves move in a direction parallel to a longitudinal axis of the elongate electrode body toward the second end of said elongate body.

13. The control electrode as claimed in claim 12, said means for preventing reflection further comprising absorbing means being adjacent the second end of the electrode body and the absorbing means absorbing said progressively moving vibrational waves.

* * * * *